United States Patent [19]

Gilmore

[11] 3,956,877

[45] May 18, 1976

[54] SPLICELESS CABLE AND METHOD OF FORMING SAME

[75] Inventor: William John Gilmore, Manitou Beach, Mich.

[73] Assignee: American Chain & Cable Company, Inc., Bridgeport, Conn.

[22] Filed: Apr. 2, 1975

[21] Appl. No.: 564,493

[52] U.S. Cl. ..... 57/145; 57/161; 57/166

[51] Int. Cl.[2] ..... D07B 1/06

[58] Field of Search..... 57/139, 142, 144, 145–148, 57/156, 159, 160, 161, 166

[56] References Cited

UNITED STATES PATENTS

| | | | |
|---|---|---|---|
| 157,931 | 12/1874 | Roebling | 57/148 |
| 1,919,509 | 7/1933 | Grobl | 57/145 |
| 2,050,298 | 8/1936 | Everett | 57/145 X |
| 2,407,634 | 9/1946 | DuPont | 57/139 X |
| 2,562,340 | 7/1951 | Stanton | 57/145 |
| 3,605,398 | 3/1970 | Carlson et al. | 57/149 |
| 3,823,542 | 7/1974 | Pemberton | 57/161 |

FOREIGN PATENTS OR APPLICATIONS

| | | | |
|---|---|---|---|
| 9,935 | 4/1909 | United Kingdom | 57/145 |

*Primary Examiner*—Donald E. Watkins
*Attorney, Agent, or Firm*—Pennie & Edmonds

[57] ABSTRACT

A spliceless longitudinally extending strand structure and method of fabricating the same which method embodies the steps of stranding at least one generally elongated strand wire about a first individual core wire segment to form a first outer layer segment, bonding a second core wire segment to the first core wire segment, bonding a second generally elongated strand wire to each of the first strand wires and stranding the second strand wires about second core wire segment as a second outer layer segment to form a continuous length of a strand structure. This process is continued until a strand structure of desired length is obtained. A stranded cable is formed by helically twisting a plurality of strand structures together. In the strand structure, the bonded joints connecting the strand wires between adjacent outer layer segments are spaced from the joint between the associated core wire segments and from each other longitudinally of the strand structure. Also, the core wires and strand wires of each of the successive segments are of decreasing diameter to form a stepped tapered structure.

17 Claims, 2 Drawing Figures

FIG. 1.
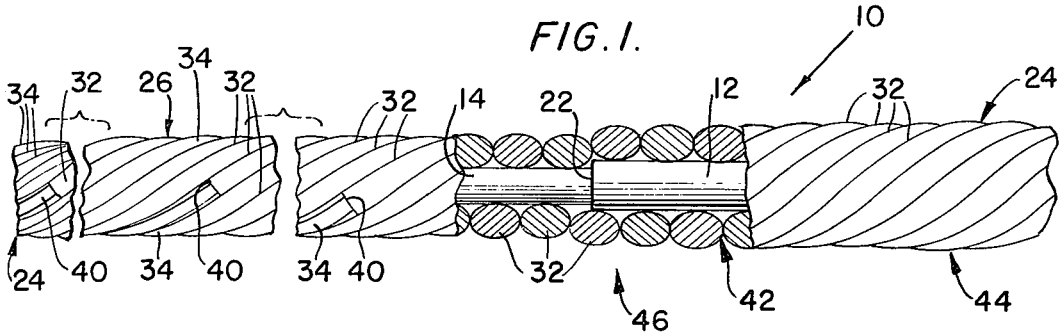
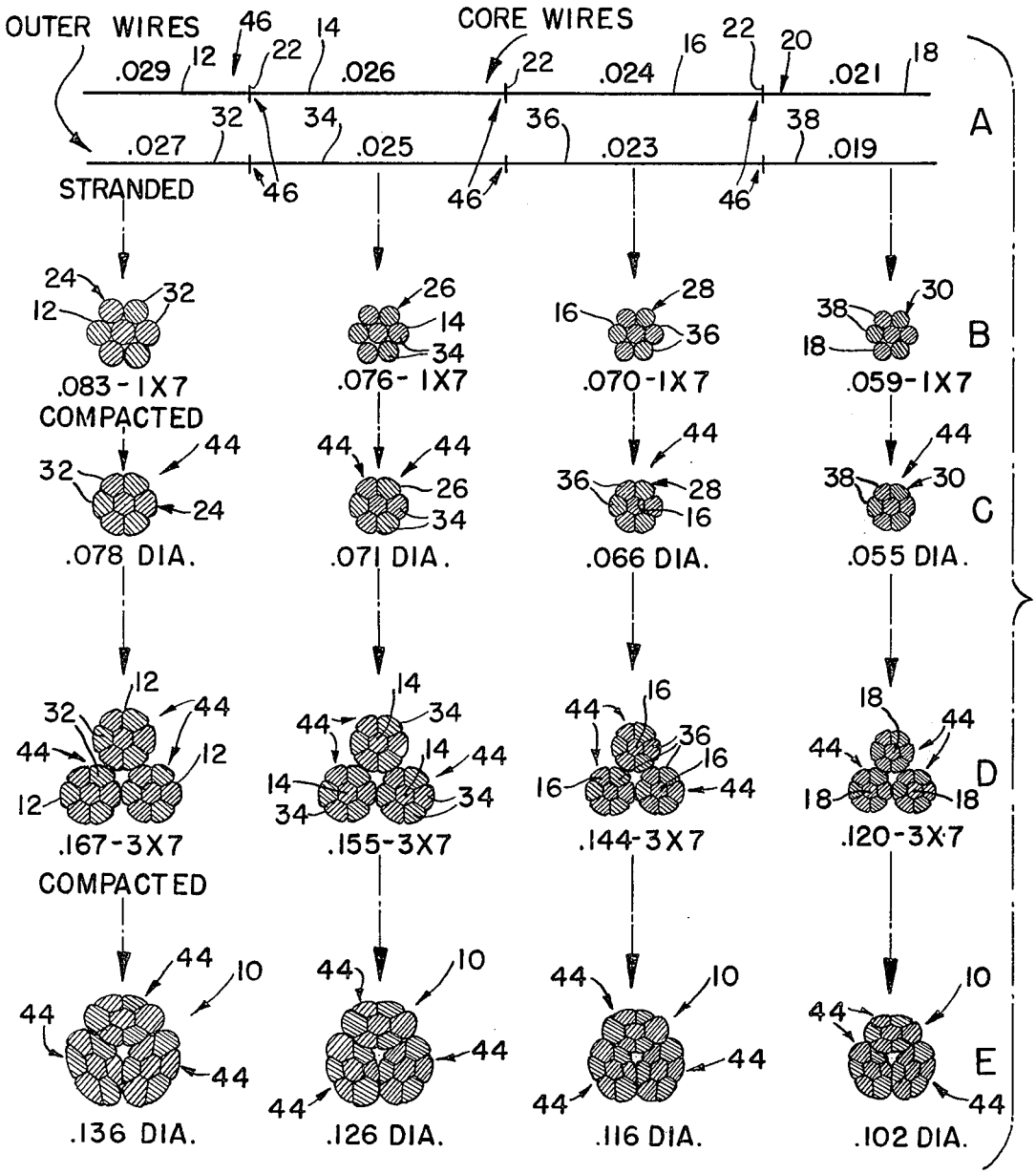
FIG. 2.

SPLICELESS CABLE AND METHOD OF FORMING SAME

BACKGROUND OF THE INVENTION

The present invention generally pertains to cable structures and, more particularly, to an improved spliceless stepped tow line especially adapted for towing objects and a method for fabricating the same. It is customary practice to tow target objects behind aircraft through the use of wire tow lines and the like. However, the modern target objects must be towed at several thousand yards behind its aircraft and at supersonic speeds to provide a practical and safe simulation of an actual target for either ground-to-air or air-to-air missles. One particular reason for the fact that the tow lines must be of sufficient length in that many missles are of the heat-seeking variety and, therefore, the towing aircraft must be kept well outside their range or otherwise it may be subject to damage. An important consideration in the construction and fabrication of these tow lines is that the specific tow cable or line have a relatively high strength to diameter ratio. The purpose for such high strength to diameter ratio is to overcome the detrimental effects produced by wind drag especially at the contemplated speeds and tow lengths that are currently used.

One prior art attempt to provide a tow line which adequately responds to the needs required for tow lines in modern high speed applications is generally described in U.S. Pat. No. 3,234,722. In this particular patent, the various layers forming a tow cable were radially compacted so as to effect an appreciable reduction in the diameter of a cable of a given rated strength to thereby correspondingly decrease the wind drag factor which would act upon such tow line.

Another prior art approach has been to utilize stepped tow lines for high speed applications, such as of the type generally described in U.S. Pat. No. 3,120,734. Since, as aforementioned, the general type of tow line utilized for towing aircraft targets extends several thousand feet the weight of such line becomes an important factor in determining the overall effectiveness thereof. Additionally, in recent years the wire lines have been required in which the material of the line is stressed to rather near its ultimate strength and at the same time such line must be capable of passing over sheaves and around a drum or reel. By reason of the relatively high speed of today's aircraft and the requirement for lengthy tow lines, a uniform diameter tow lines will tend to part under tension generated by its own air resistance or drag even though the weight in drag of the towed objects is comparatively small. Under such circumstances it is essential that the outer end of the line be as small as possible so as to minimize the drag as the diameter increases towards the inner end to compensate for tension generated by the drag of the line outboard. Theoretically, at least, the line should be generally tapered. Although the latter aforementioned patent discloses a technique for producing stepped tapered tow lines, such technique requires that the tow line be spliced together so as to join strands of different diameters. This form of stepped tapered tow line has been generally successful in many applications.

With, however, the advent of larger scale size targets, such as in the order to two-thirds the actual size, there is a corresponding resultant increase in the towing load such that there is an increase in tension generated by the drag or air resistance. Accordingly, to compensate for such resulting increases in drag, it is desirable to have the outer end of the line as small as possible as well as have the general strength of the tow line increased.

Unfortunately, spliced stepped tow lines of the type generally described in the above referenced patent whenever employed in typical types of turbine driven payout and retraction devices currently adapted for use on operational aircraft are limited to a particular size or diameter of tow line. This is by virtue of the fact that the overlie strand and flat wire armour at each of the joints tend to limit the diameter of the top sized strand in the tow line. Such diameters which may be used, however, are generally not as strong and, therefore, tend to be inadequate to meet the demands placed thereon. As noted, these increased demands are attributable to the fact that in modern type tow targets there is a general increase in the size and weight of the towed target object, as well as an increased length of the tow line necessitated by the use of extended scopes for the target practice.

Present day approaches to overcome the unsatisfactory results attendant with the use of the known spliced stepped tow lines under these circumstances are the utilization of constant diameter tow lines having greater diameter and greater number of individual wires stranded together so as to provide the adequate strength necessary for the purposes aforementioned. By way of example, these present day approaches have utilized 0.180 3 × 7 and 0.230 3 × 19 constant diameter wires which respectively have reel capacities of approximately 10,000 and 8,000 feet. Such constant diameter lines, of course, are not as suitable as would be desired, especially in light of the stress and weight imposed thereby.

SUMMARY OF THE INVENTION

Accordingly, therefore, it is the object of the present invention to overcome the prevalent shortcomings attendant with the use of conventional tow lines utilized for towing large objects by aircraft by providing a single continuous cable structure which is generally stepped tapered and wherein the size of the base strands may be larger in diameter than heretofore known base strands in spliced and generally tapered or stepped tow lines.

The present invention provides for a novel and improved spliceless stepped or generally tapered tow line or cable structure. Such cable construction is preferably comprised of three tapered and radially compacted strands which are closed or twisted together. Each strand may be comprised of a plurality of discrete core wire segments; and associated with each segment is an outer layer of strand wires. It is contemplated that each of the core wire segments have a different diameter with respect to the others and be so arranged in end-to-end relationship that they form a progressively decreasing diameter. Their opposite ends are fixedly secured or joined together by welding or the like. In this fashion, a continuous cable core is formed.

The outer layer of the plurality of strand wires that surround each individual core wire segment is of a given diameter. Each longitudinally adjacent layer stranded about the underlying cable core segment has a diameter which differs from the other layers such that they similarly form a progressively diminishing or decreasing diameter which extends in the same direction as the taper of the core segments. The adjoining ends of each of the respective strand wire segments when so arranged are joined or secured together as by welding. It is preferred that the location of the individual weld joints between each longitudinally adjacent strand wire in the adjoining outer layer segments be staggered so as to provide for a relatively stronger cable. The present invention also envisions that the outer layer of strand wires be radially compacted on the welded central core wire.

In accordance with the teachings of the present invention, the method for fabricating the spliceless, tapered or stepped tow line construction generally comprises the steps of stranding a plurality of first strand wires about a first central core wire segment, welding or otherwise suitably joining a second core wire segment to the first core wire segment, welding respective ones of a plurality of second strand wires to the first strand wires, and continuing the stranding and joining procedure with wire segments of progressively changing diameters until the desired length of strand is formed. The positions of the welded joints for each of the respective adjoining strand wires are staggered or spaced from each other. By virtue of the foregoing sequence of steps a continuous stepped tapered strand is formed. Thereafter, such strand may be compacted, in a conventional fashion, so as to reduce the diameter thereof. Upon completion of such compaction, two other similarly formed strands are closed or twisted with the first strand so as to form a continuously stepped tapered cable structure or two line. Additionally, a second compaction step is performed to further reduce cable diameter. Such double compaction has been found to increase the general fatigue strength of the cable.

BRIEF DESCRIPTION OF THE DRAWINGS

FIG. 1 is a fragmented partially sectioned side elevational view of the stepped spliceless tow line embodying the principles of the present invention illustrating one of the transition joints between central core wires having different diameters; and FIGS. 2A through 2E illustrate a preferred sequence of operational steps followed to form a stepped spliceless tapered cable of the present invention.

DETAILED DESCRIPTION OF PREFERRED EMBODIMENT

With specific reference to FIG. 2A, the cable 10 is shown as including a plurality of discrete, generally elongated core wire segments 12, 14, 16 and 18. In this particular embodiment, four such core wire segments 12, 14, 16 and 18 have been disclosed; however, the present invention envisions that any suitable number may be satisfactorily utilized. To provide for the general stepped tapered configuration, each of core wire segments 12, 14, 16 and 18 has a diameter which is different from that of the other core wire segments. The respective core wire segments 12, 14, 16 and 18 are joined together in an end-to-end relationship so as to form a single continuous core 20 with adjacent segments of progressively diminishing diameter. The core segments are joined together by butt welding as indicated by the joints 22. Alternatively, other similar bonding techniques may be employed, such as, for example, brazing, soldering, etc.

Outer layer segments 24, 26, 28 and 30 (see FIG. 2C) having varying diameters are associated with core wire segments 12, 14, 16 and 18, respectively. Such outer layer segments are composed of a plurality of strand wires 32, 34, 36 and 38, respectively, which are stranded to the core wire segments 12, 14, 16 and 18.

As shown in FIG. 2A, the outer strand wires 32, 34, 36 and 38 each have a diameter which is less than the given diameter of the core wire segments they are to be in contact with. Also as indicated the diameters of the respective strand wires 32, 34, 36 and 38 forming each of the outer layer segments 24, 26, 28 and 30 decrease in the same direction as the core segments with which they will be associated. Accordingly, when the outer layer segments are stranded and joined at joints 40, as by butt welding, in an end-to-end relationship, they form a continuous stranded outer layer 42 comprised of the segments 24, 26, 28 and 30 which are of progressively diminishing diameters. It will, of course, be appreciated that the resultant strand structure 44 formed by the cable core member 20 and stranded outer layer 42 will be free from bulky spliced sections. Thus, whenever such spliceless cable is wrapped about a reel in a conventional payout and retraction device, the effective diameters of the strands need not be limited as when spliced sections are utilized. In addition, the strength of a cable 10 for towing or the like correspondingly increases with the resultant increase in wire diameter afforded by the absence of spliced sections.

As for the method of production of the cable of the present invention, the core wire segment 12, as well as at least one outer strand wire 32, of outer layer segment 24 is advanced through and suitably worked upon by a well-known type of strander machine (not shown). In a preferred embodiment, six such strand wires 32 are utilized. Since the construction and operation of such a strander is well known in the art and further since it does not form an aspect of the present invention, details of its construction and operation have been omitted. The strander machine essentially operates to strand the outer strand wires 32 about the core segment 12 as well as the outer strand wires 34, 36 and 38 about their respective core segments 14, 16 and 18.

Such an arrangement provides for what is commonly referred to as a 1 × 7 strand structure; that is, one strand consisting of seven wire elements. Inasmuch as the outer strand wires 32, 34, 36 and 38 are to be helically wrapped about their respective core wire segments, they must, as is well known, have a length which suitably exceeds that of core wire segments. The determination of such length is considered to be well within the skill of this particular field.

Prior to completing the stranding of core wire segment 12 and outer wires 32, the end of the core segment 12 is butt welded at 22 to the core segment 14 as shown in FIG. 1, to form a securely integrally united joint. Likewise, respective ones of the outer strand wires 32 are butt welded at 40 to strand wires 34 which are to form the outer layer segment 26. The respective weld joints 40 for each of the strand wires 32 and 34 are made at staggered locations along the longitudinal extent of the strand 44.

As is generally known, butt welding of adjoining wire ends produces a joint which is relatively brittle and not as strong in tensile strength as say, for example, a uniform wire without weld joints. Accordingly, such weaker joint will fail with less tensile force applied thereto than say a typical continuous segment of wire. Although annealing of welded joints may somewhat alleviate the brittleness and somewhat improve the tensile strength, nonetheless, the tensile strength is relatively less than it would be with a continuous segment of wire. To overcome this shortcoming, the weld joints 40 are staggered relative to each other and relative to the weld joints 22 along the longitudinal extent of the strand structure 44. The staggered relation of the weld joints 40 of the respective adjoining strand wires 32 and 34 is clearly denoted in FIG. 1. Also, in FIG. 1, the relative difference between the dimensions of the wires 32 and 34 has been somewhat exaggerated for purposes of illustration.

With a staggered arrangement of the weld joints 40, failure of one joint, due to the application of an excessive axial force applied to the strand wires 32 and 34, will not cause unwinding of the separated ends from the strand structure 44. This is so since the strand wires 32 and 34 are helically and tightly wrapped about the underlying core wire segments 12 and 14 and are in frictionally tight engagement with the adjacent helically wound strand wires 32 and 34. The severed portions of the strand wires 32 and 34 are simply not able to unwind through the tortuous friction path they normally assume. It will be appreciated, therefore, that staggering each successive weld joint 40 at spaced intervals from joints 22 and from each other will provide for a relatively stronger strand structure 44. The staggering may be performed in either a controlled or random fashion. In a controlled fashion, the spacing is at controlled intervals and provides for greater consistency of strength between many mass produced cables.

It will, of course, be understood that at a transition zone 46 between core wire segments 12 and 14 and outer layer segments 24 and 26, the conventional procedure of adjusting the lay length will be performed. In addition, the closing sizes for the wires will be adjusted, consistent with sound engineering practice, for purposes of accommodating different sized wires. While the foregoing description has been applied with respect to one of the transition zones 46 between two different core segments and outer layer segments, it should, of course, be appreciated that the foregoing procedural steps shall be applied to the other transition zones 46 until a strand structure 44 of desired length is attained.

At the completion of the formation of a particular strand structure 44, the strand 44 is preferably radially compacted in a standard manner, such as by swaging or the like. See FIG. 2C. As a consequence thereof, the diameter of the strand is reduced. The decrease in diameter reduces wind resistance on the strand 44, whenever it might be desirable to utilize such strand for aircraft towing purposes. The compaction serves to compact the strand wires 32, 34, 36 and 38 closely about their respective core wire segments 12, 14, 16 and 18 and rounds off the outwardly disposed "crown" surfaces of such strand wires.

In the preferred embodiment of the cable constructed according to the teachings of the present invention, three strands 44, constructed as described above, are closed or twisted with respect to each other, such as in the same manner indicated in FIG. 2D. During this closing or twisting operation it will, of course, be appreciated that the general direction of taper for each strand 44 is the same. It should also be noted that the closing or twisting of these strands 44 is accomplished through the use of a strander machine in a known manner. Also, an operator of such strander will in accordance with conventional practice, appropriately adjust lay length as well as clsoing size for the strands 44. While the foregoing preferred embodiment has been discussed with three strands 44 forming the cable 10, it is to be noted that other suitable numbers of strands 44 may be appropriately twisted or stranded together without departing from the scope of the present invention.

At the conclusion of this closing operation of the three strands, the resulting cable is preferably radially compacted by any well-known kind of radial compaction procedure. Specifically referring to FIG. 2E there is shown a plurality of cross-sectional views, each of which depict the individual strands 44 after having been further radially compacted. Such compaction may be carried out until a predetermined diameter for the cable 10 is attained. As previously observed, the reduction of diameter is of great importance in tow line application. It has been determined that the double compaction besides reducing overall cable diameter and increasing compactness, unexpectedly increases fatigue life of cable 10.

The resultant wire arrangement is referred to as 3 × 7 cable construction; that is, three individual strands 44 each having seven individual wire elements or filaments. Through use of a 3 × 7 cable construction, bunching of the tow line, which is rather typical 1 × 7 or 1 × 19 constructions, is avoided. Accordingly, the possibility of system malfunction is substantially reduced.

The following example of a cable structure is set forth as a presently preferred embodiment of the present invention. The cable includes core wire segments 12, 14, 16 and 18, which longitudinally extend to a distance of about 5,000 feet, and respectively have diameters of about 0.029, 0.026, 0.024 and 0.021 inches. The strand wires 32, 34, 36 and 38 which are respectively stranded about the core wire segments 12, 14, 16 and 18 each have lengths of approximately 5,200 feet, with diameters of 0.027, 0.025, 0.023, and 0.019 inches. The core and strand wires are stranded to form a 1 × 7 strand structure having respective segments with diameters of 0.083, 0.076, 0.070 and 0.059 inches. Of course, the strand wires 32, 34, 36 and 38 and core segments 12, 14, 16 and 18 are suitably welded together in the manner indicated above. Such strand segments are radially compacted and their diameters are correspondingly reduced to 0.078, 0.071, 0.066 and 0.055 inches. The resultant spliceless and tapered strand structure 44 extends for a distance of approximately 20,000 feet. To provide a cable 10 with improved performance characteristics, three such 20,000 foot length cables 10 are twisted or closed together to form a 3 × 7 construction. The different sections of the resulting 3 × 7 cable as shown in FIG. 2D have the following diameters: 0.167, 0.155, 0.144 and 0.120 inches. Such a 3 × 7 cable construction is further compacted, see FIG. 2E, so that the resultant diameters of the respective segments are 0.136, 0.126, 0.116 and 0.102 inches.

The final product is a continuous 20,000 foot length of 3 × 7 cable construction tow line 10 having four sections of different diameters with no bulky spliced sections, no bitter end wires, and no strand wire diameters larger than the base or core wire strand. Size, therefore, will not be limiting and obviously the spliceless stepped concept can be used with larger diameter wire so as to result in a stepped tow line with maximum strength and length.

Accordingly, the above description is of a preferred 3 × 7 cable construction, it is to be understood that the present invention is not limited to such a cable and can be used in other cable and strand constructions where the stepped configuration is desired.

What is claimed is:

1. The method of fabricating a spliceless longitudinally extending strand structure comprising the steps of:

a. stranding a first outer layer segment comprising at least one generally elongated strand wire about a first core wire segment;

b. bonding a second generally elongated core wire segment to the first core wire segment;

c. bonding a second generally elongated strand wire to each of the first strand wires; and d. stranding the second strand wires about the second core wire segment as a second outer layer segment to form a continuous length of a strand structure.

2. The method as set forth in claim 1 wherein:

a. the step of bonding each of the first and second strand wires is performed such that the joints between the strand wires are spaced from the joint of the first and second core wire segments and spaced from each other longitudinally of the strand structure.

3. The method as set forth in claim 2 which further comprises the steps of:

a. radially compacting the bonded first and second wire strands about the core segments.

4. The method as set forth by claim 2 which further comprises the steps of:

a. twisting a plurality of additional strand structures, formed similarly to the first strand structure, with the first formed strand structure to form a cable.

5. The method as set forth in claim 4 wherein:

a. three similarly formed strand structures are helically twisted together to form said cable.

6. The method as set forth in claim 4 which further comprises the steps of:

a. radially compacting the bonded first and second wire strands about the core segments after formation of the strand structure; and b. radially compacting the first and second strand structures after formation into said cable.

7. The method as set forth in claim 6 wherein:

a. the core wire segments and strand wires are each bonded to respective core and strand wires by butt welding.

8. The method of fabricating a spliceless longitudinally extending tapered cable structure comprising the steps of:

a. stranding a first outer layer segment, comprising at least a first generally elongated strand wire, about a first core wire segment;

b. butt welding a second generally elongated core wire segment, having a different diameter than the first core wire segment, to the first core wire segment;

c. butt welding a second generally elongated strand wire, having a different diameter than the first strand wire, to each of the first strand wires;

d. stranding the second strand wires about the welded second core wire segment as a second outer layer segment to form a continuous length of tapered strand structure;

e. continuing the stranding and welding steps described in steps (*a*) – (*d*) until the desired length of strand structure is formed while longitudinally spacing the individual weld joints connecting each adjacent core wire and outer layer segment; and f. helically twisting a plurality of additional strand structures formed similarly to the first strand structure with the first strand structure to form a cable.

9. The method as set forth in claim 8 wherein:

a. the diameter of each successive core wire segment and each successive strand wire changes in a similar mode to form a tapered strand and cable structure.

10. The method as set forth in claim 9 wherein:

a. three strand structures are twisted together to form said cable.

11. A spliceless tapered strand structure comprising:

a. a first core wire segment having a first diameter;

b. a second core wire segment having a second diameter which is less than the first diameter, 1. said second core wire segment being butt welded at a first joint to the first core wire segment;

c. a first outer layer segment, comprising at least one strand wire stranded about the first core wire segment; and d. second strand wires butt welded at strand joints to each of the first strand wires and being stranded about the second core wire segment as a second outer layer segment to form a continuously tapered strand structure.

12. The structure as set forth in claim 11 further comprising:

a. additional core wire segments and additional strand wires of decreasing diameters, welded and stranded as defined in claim 11 to form a continuously tapered strand structure of desired length.

13. The structure as set forth in claim 12 wherein:

a. the successive stranded outer layer segments are radially compacted.

14. The structure as set forth in claim 12 wherein:

a. the diameter of the strand wires in each outer layer segment is less than the diameter of the associated core wire segment.

15. The structure as set forth in claim 12 wherein:

a. the joints between the strand wires of adjacent layer segments are spaced from the associated joint between the core wire segments and from each other longitudinally of the strand structure.

16. The structure as set forth in claim 14 further comprising:

a. a plurality of additional strand structures, of the same construction as the first strand structure of claim 14 helically twisted with the first strand structure with the tapers of each being in the same direction to form a continuously tapered cable structure.

17. The structure as set forth in claim 16 wherein:

a. the strand structures are radially compacted after formation into said cable structure.

* * * * *

UNITED STATES PATENT AND TRADEMARK OFFICE

CERTIFICATE OF CORRECTION

PATENT NO. : 3,956,877

DATED : May 18, 1976

INVENTOR(S) : William J. Gilmore

It is certified that error appears in the above-identified patent and that said Letters Patent are hereby corrected as shown below:

Column 1, line 17, "in" should read --is--;

line 51, "lines" should read --line--.

Column 3, line 30, "two" should read --tow--.

Column 5, line 59, "in the same manner" should read --in the manner--.

Column 6, line 67, "Accordingly" should read --Although--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*